United States Patent [19]

Zverev et al.

[11] 4,279,383

[45] Jul. 21, 1981

[54] APPARATUS FOR COATING BY DETONATION WAVES

[76] Inventors: Anatoly I. Zverev, ulitsa Bratislavskaya, 26, kv. 22; Evgeny A. Astakhov, ulitsa Vyborgskaya, 89a, kv. 46; Valery S. Klimenko, ulitsa Shepeleva, 14, kv. 9; Vasily G. Skadin, prospekt Malinovskogo, 7, kv. 50, all of Kiev; Mikhail A. Timoshin, Setunsky proezd, 4, kv. 24, Moscow, all of U.S.S.R.

[21] Appl. No.: 19,754

[22] Filed: Mar. 12, 1979

[51] Int. Cl.[3] ..... B05B 7/22

[52] U.S. Cl. ..... 239/61; 118/688; 222/52; 239/64; 239/81; 239/85

[58] Field of Search ..... 222/52; 118/688, 689, 118/690; 239/79, 81, 85, 61, 63, 64

[56] References Cited

U.S. PATENT DOCUMENTS

| | | | |
|---|---|---|---|
| 2,570,600 | 10/1951 | Sargrove | 118/688 X |
| 2,714,563 | 8/1955 | Poorman et al. | 239/85 X |
| 3,884,415 | 5/1975 | Zverev et al. | 239/79 |
| 3,995,681 | 12/1976 | Schmid et al. | 118/688 X |

FOREIGN PATENT DOCUMENTS

| | | | |
|---|---|---|---|
| 523846 | 9/1976 | U.S.S.R. | 239/85 |

OTHER PUBLICATIONS

"Engineering of the Metal-Working Industry: Detonation Coatings and Their Uses", Niimash Publishers, Moscow, 1977, pp. 25–30.

"Powder Metallurgy: Fundamentals, Engineering Aspects and Properties of Powders and Fibers", Syrkin et al., Moscow, 1970, No. 4(88), pp. 30–34.

*Primary Examiner*—Andres Kashnikow

*Attorney, Agent, or Firm*—Lackenbach, Lilling & Siegel

[57] ABSTRACT

The disclosed apparatus includes a detonation chamber constructed in the form of a barrel, a spark plug mounted in the barrel and powder feeding and gaseous mixture delivering systems communicating with the detonation chamber. The powder feeding system include a batchmeter communicating with the source of carrier gas by means of a gas conduit with a control member of the carrier gas feed controller for controlling the quantity of carrier gas delivered to the batchmeter within a unit of time mounted thereon. The apparatus also includes a control system having a powder detector for detecting powder in the detonation products, electrically connected with a control unit. The control unit effects switching on of the mechanisms and the systems in a predetermined succession and switching on of the actuating mechanism of the carrier gas feed controller, depending on the detector signal indicative of the powder presense in the detonation products.

7 Claims, 4 Drawing Figures

APPARATUS FOR COATING BY DETONATION WAVES

BACKGROUND OF THE INVENTION

1. Field of the Invention

The present invention relates to the technology of coating by high-temperature atomization, more particularly to an apparatus for coating by detonation waves. The invention may find application in metallurgy, chemistry, power and mechanical engineering, and other branches of industry where the requirements placed upon the products are such that these products be made entirely from the coating material either by casting or by caking.

2. Description of the Prior Art

The quality of coating produced by the method of detonation waves depends mainly upon the temperature and velocity of the coating material particles. Hence, in the preceding apparatus for coating by detonation waves, comprising originally a detonation chamber, a device for firing the explosion, a gaseous mixture delivering system and a powdered material feeding system (see U.S. Pat. No. 2,714,563), whose construction practically remained unchanged, the improvements aimed at perfecting the quality of coating have been made mainly in the systems for feeding gaseous mixture and the powdered material to the detonation chamber, the aforementioned parameters depending upon the functioning of said feeding systems.

Constructional changes in the gaseous mixture delivering system were aimed at the provision of homogeneity of the gaseous mixture delivered to the detonation chamber, which is required to maintain optimum thermodynamic parameters of the coating process.

Numerous improvements introduced in the powered material feeding system were aimed at the optimization of the place, time, and speed of injection of powdered material into the detonation chamber (see "Engineering of the Metal-Working Industry: Detonation Coatings and Their Uses", Niimash Publishers, Moscow, 1977, pp 25–30). However, one factor has not been taken into account, which factor substantially affects the quality of coating, namely, uniformity of the quantity of powdered coating material introduced in the detonation products. Besides, to stabilize the batch of powder being fed to the detonation chamber and interacting with the products of detonation is one of the primary conditions necessary for obtaining high quality coating. At the same time existing apparatuses for coating by detonation waves practically do not provide for a stable rate of feeding of powder into the detonation chamber, which is explained by the instability of the physical properties of the powder as well as by obstructions in the powder feeding conduits, conditioned by the coating technology.

Known in the art is an apparatus for coating by detonation waves, comprising a detonation chamber in the form of a barrel closed at one end, a spark plug mounted in the barrel, a powder feeding system, and a gaseous mixture delivering system, both communicating with the detonation chamber (see U.S. Pat. No. 3,884,415). The gaseous mixture delivering system comprises a mixer communicating with the sources of the gaseous mixture ingredients. The powder feeding system comprises a batchmeter having a hopper for powdered coating metal and a tubular body communicating with the detonation chamber through a delivery pipe. Connected with the tubular body is a gas conduit connecting the batchmeter with the source of a carrier gas. At the outlet of the gas conduit there is installed a valve. In the tubular body there is mounted a slide valve simultaneously serving as a splitter.

The apparatus also comprises a control system including a control unit having a driver unit electrically connected to the gaseous mixture delivering system, the spark plug and the powder feeding system through their respective control circuits.

The powder is fed to the detonation chamber when in response to a signal received from the control unit the batchmeter opens. Carrier gas enters the cavity of the tubular body and moves the slide valve so that the tough formed therein, preliminarily coinciding with the hopper outlet and filled now with the powder, coincides with the delivery pipe connecting the tubular body with the detonation chamber and the by-pass conduit communicating with the cavity of the tubular body filled with the carrier gas. As a result, a batch of powder in the trough of the slide valve is injected into the detonation chamber.

Despite constant volume of the trough in the slide valve, which determines the amount of powder fed to the detonation chamber, the detonation chamber volume may vary, because with the decrease of the powder level in the batchmeter bunker the rate of the powder flow also decreases, which in turn results in a decreased amount of powder entering the trough of the slide valve. In addition, the quantity of powder in the batch may decrease with the decrease of the clear opening of the delivery pipe due to choking or partial sculling thereof. Decreased amount of the powder being fed to the detonation chamber leads to overheating and burning of the powder during the explosion.

Besides, as the absolute value of mechanical losses of powder practically does not depend upon its amount in the detonation products, in case of small batches the part of the above losses relative to the initial quantity of the powdered coating material increases, thereby affecting economic efficiency of the coating technology.

SUMMARY OF THE INVENTION

The principal object of the present invention is to provide an apparatus for coating by detonation waves, insuring a higher quality of coating, which is obtained by stabilizing the size of portions of powdered coating material fed to the detonation chamber.

Another object of the invention is to provide an apparatus for coating by detonation waves, insuring decreased waste of the ingredients of the gas mixture and lower energy losses.

The invention consists of an apparatus for coating by detonation waves, comprising a detonation chamber in the form of a barrel closed at one end; a spark plug mounted in the barrel; a powder feeding system including a batchmeter with a hopper for the powdered coating material, and communicating with the detonation chamber and through a gas conduit with the source of carrier gas; a gaseous mixture delivering system including a mixer communicating with the detonation chamber; and a control system comprising a control unit having a driver unit electrically connected with the spark plug, the powder feeding system and the mixture delivering system, through control circuits thereof respectively. According to the invention, the powder feeding system comprises a carrier gas feed controller for controlling the quantity of carrier gas delivered to the batchmeter per unit time, mounted on the gas conduit, and wherein as a batchmeter is utilized a feeder with a hopper connected with a gas conduit. The control system comprises a powder detector for detecting powder in the detonation products, said powder detector being mounted at the open end of the barrel and electrically connected with the control unit through a transducer for converting signal from the powder detector. The control unit comprises a threshold element for switching on an actuating mechanism of said feed controller, which is electrically connected with said actuating mechanism and connected to said transducer.

The above apparatus enables the size of the powder portion in the barrel to be adjusted owing to the controlled supply of carrier gas to the batchmeter.

Constant quantity of the powder in the detonation products eliminates disrupture of the temperature conditions of the coating process, which insures high quality of coating, with the other parameters of the process being observed.

As a feed controller, for controlling the quantity of carrier gas being supplied to the batchmeter per unit time, can be utilized a pressure regulator.

It is expedient that the control unit include a threshold element for switching off the apparatus, having an operation threshold lower than that of the threshold element for switching on the actuating mechanism, and corresponding to the powder detector signal indicative of the absence of the powder in the detonation products. The threshold element for switching off the apparatus may be connected to the transducer for converting the detector signal in parallel with the threshold elements for switching on the actuating mechanism and electrically connected with a carrier gas feed controller so that in case of simultaneous operation of both threshold elements the actuating mechanism of the carrier gas feed controller is switched off. The control system has a switch connected between the transducer for converting a signal from the detector and the junction point of said threshold elements, and being intended for connecting said threshold elements with the source of direct voltage at the moment of the first explosion, said source imitating the detector signal indicative of the full size portion of powder in the products of detonation.

Such construction of the control unit eliminates the possibility of idle running of the apparatus, i.e. the operation without the coating material powder being present in the products of detonation, thereby decreasing waste of the ingredients of the gaseous mixture and the energy required for detonation. In addition, the probability of affecting the coating quality due to the thermal effect of the detonation products on the base layer material or on the previously built coating layer is also descreased.

As the threshold element for switching on the actuating mechanism and the threshold element for switching off the apparatus may be utilized a first and a second electromagnetic relays. The second electromagnetic relay may have make contacts in the control circuits of the mixer, of the spark pulg and of the batchmeter and in the supply circuit of the drive of the actuating mechanism of the carrier gas feed controller. The first electromagnetic relay may have a break contact in the same supply circuit, said break contact being connected in series with the make contact of the first electromagnetic relay. Such construction eliminates the possibility of switching on the actuating mechanism of the carrier feed controller in case of simultaneous operation of said electromagnetic relays.

If the actuating mechanism of the carrier gas feed controller is constructed in the form of a thyristor drive, it is expedient that the control unit have a logic circuit comprising a coincidence circuit and an inverter connected to one of the inputs of the coincidence circuit, the other input of which is connected to the threshold element for switching on the actuating mechanism. The output of the coincidence circuit is connected to the thyristor drive; and the input of the inverter is connected to the output of the threshold element for switching off the apparatus, said output being also connected to the driver unit. Like in the above embodiment of the apparatus such construction of the control unit eliminates the possibility of switching on the actuating mechanism of the carrier gas feed controller in case of simultaneous operation of the threshold elements. It enables the accuracy of the apparatus operation to be improved, which is particularly important for laboratory research work. As the brightness of the light flux emitted by the detonation products depends on the quantity of powder of the coating material present in said products, it is expedient to construct a powder detector, for detecting powder in the detonation products, in the form of a photocell.

It is useful to connect to the transducer an instrument for visually checking the quantity of powder in the detonation products.

BRIEF DESCRIPTION OF THE DRAWINGS

The invention will now be described with reference to embodiments thereof in conjuntion with the accompanying drawings in which.

DETAILED DESCRIPTION OF THE INVENTION

Figure 1:
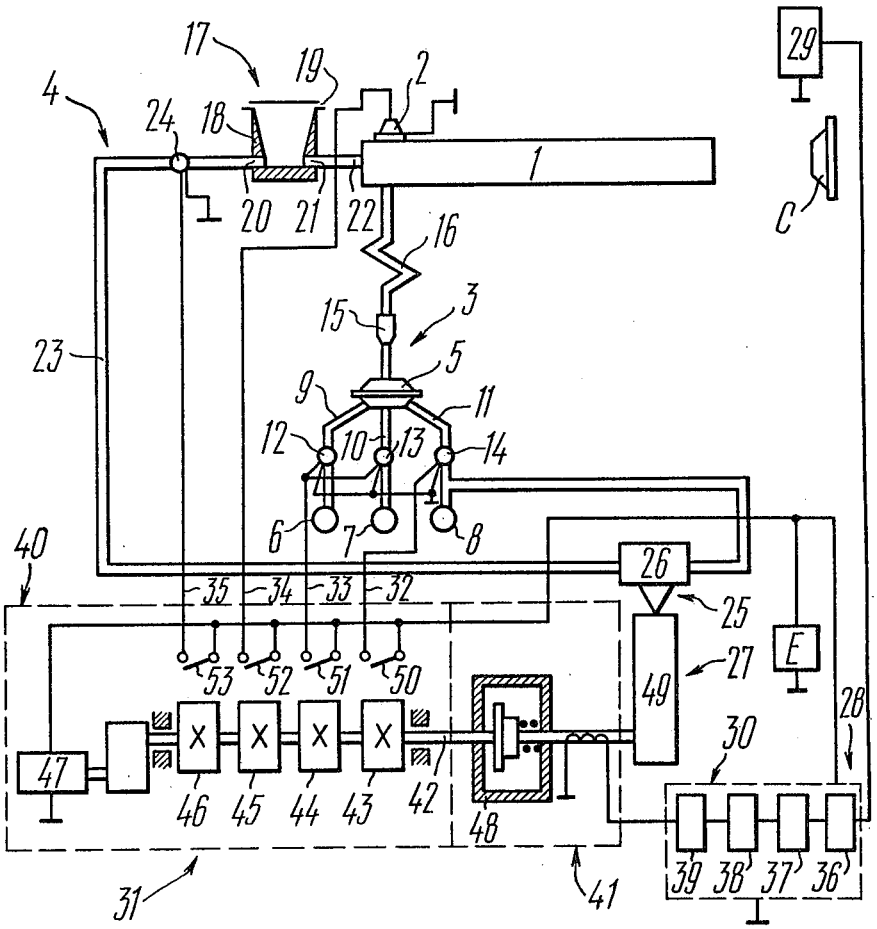
FIG. 1 is a schematic diagram of the apparatus for coating by detonation waves according to the invention.

The apparatus for coating by detonation waves comprises a detonation chamber 1 (FIG. 1) which is a cylindrical barrel closed at one end, a spark plug 2 mounted in the barrel and intended for initiating detonation, a gaseous mixture delivering system 3 and a powder feeding system 4, both said systems communicating with the detonation chamber 1.

The gaseous mixture delivering system 3 comprises a mixer 5 intended for producing a gaseous mixture composed of a gas fuel (acetylene, for example), an oxidant (oxygen, for example), and a neutral gas (nitrogen, for example). Respective sources 6, 7 and 8 of said ingredients of the gaseous mixture communicate with the mixer 5 through mains 9, 10 and 11, having valves 12, 13 and 14 respectively. The mixer 5 communicates with the detonation chamber 1 through a check valve 15 and a coiled pipe 16, adapted for damaging the back impact.

The powder feeding system 4 comprises a batchmeter 17 including a hopper 18 having a first inlet 19 for charging the powdered coating material, a second inlet 20 for delivering carrier gas, and an outlet 21 communicating with the combustion chamber 1 through a delivery pipe 22. Through a gas conduit 23 connected with the inlet 20, the hopper 18 communicates with the source of carrier gas, which, according to this embodiment, is the source 8 of neutral gas. The batchmeter 17 many include, according to the invention, a known in the art pulse feeder (see USSR Inventor's Certificate No. 523846 (1976). Other types are also possible for example, gas jet feeder of propeller type, or gas jet feeder with perforated ring see "Powder Metallurgy: Fundamentals, Engineering Aspects and Properties of Powders and Fibers", by Syrkin et al, Moscow, 1970, No. 4(88), pp. 30–34). In principle, any feeder provided with a hopper connected with a gas conduit of carrier gas may be utilized as the batchmeter 17.

The gas conduit 23 has a valve 24 installed thereon close to the inlet 20 of the hopper 18, said valve providing for delivery of a carrier gas into the batchmeter.

The powder feeding system 4 also comprises a carrier gas feed controller 25 for controlling the quantity of carrier gas delivered to the batchmeter within a unit of time. The controller 25 has a controlling member 26 mounted on the gas conduit 23, and an actuating mechanism 27 electrically or kinematically connected with the controlling member 26.

The carrier gas feed controller 25, in the preferred embodiment of the invention, is constructed in the form of a pressure regulator. Alternatively it may be a throttle of any kind provided with a drive.

The apparatus comprises also a control system 28, electrically connected with the mixer 5, the spark plug 2, the batchmeter 17 and the carrier gas feed controller 25. The control system 28 comprises a powder detector 29 for detecting powder in the detonation products, mounted at the open end of the barrel; a transducer 30 for converting a powder detector signal, electrically connected with said powder detector; a control unit 31 electrically connected with the transducer 30; and mixer control circuits 32 and 33, a spark plug control circuit 34, and a batchmeter control circuit 35 electrically connected with the control unit 31.

The powder detector 29 is constructed in the form of a photocell. As the detonation products ejected from the barrel, as a result of detonation, produce luminous radiation, any additional light source is not needed. Devices of other types may be utilized instead of the photocell, for example a pyrometer probe.

The transducer 30 comprises a voltage amplifier 36, a power amplifier 37, an integrating RC circuit 38, and a power amplifier 39 connected in series. The voltage amplifier 36 is connected to the powder detector 29, and the powder amplifier 39 is connected to the control unit 31.

The control unit 31 comprises a driver unit 40 electrically connected with control circuits 32, 33, 34 and 35, and a threshold element 41 for switching on the actuating mechanism 27 of the device 25. The threshold element 41 has an input connected to the transducer 30, and an output electrically connected with the actuating mechanism 27.

The driver unit 40, shown in FIG. 1 is, in fact, a command apparatus comprising a shaft 42 having cams 43, 44, 45 and 46, and a drive 47 connected with the shaft 42, said drive comprising a motor and a gear box.

The function of the threshold element 41 in the unit 31 is performed by a coil of a normally closed electromagnetic clutch 48 mounted on the shaft 42 of the command apparatus. Between said coil, having its input leads connected to the transducer 30, and the actuating mechanism 27 there is effected electromagnetic connection by means of the core of the coupling 48, said core being connected with a driving shaft of a gearbox 49 which is a component of the actuating mechanism 27. The drive 47 of the command apparatus is in this case the drive of the actuating mechanism 27.

The cam 43 of the driver unit 40 is in contact with a switch 50 of the mixer control circuit 32 connected to the valve 14, and the cam 44 is in contact with a switch 51 of the mixer control circuit 33 connected with valves 12 and 13. In the same manner the cams 45 and 46 are in contact with switches 52 and 53 of the spark plug control circuit 34 and the batchmeter control circuit 35 respectively.

The control unit 31 as any device it comprises may be otherwise constructed.

Figure 2:
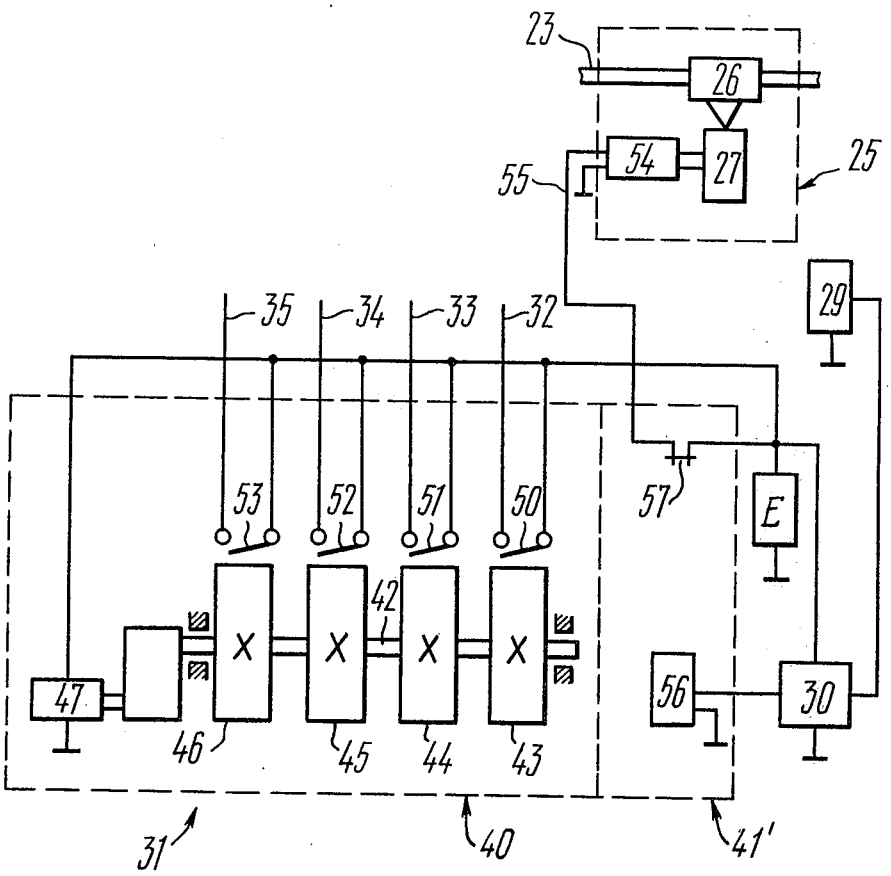
FIG. 2 is a schematic diagram of the control system of one embodiment of the apparatus according to the invention.

In FIG. 2 there is shown the control unit 31 having the threshold element 41′ made in the form of an electromagnetic relay. The actuating mechanism 27 of the feed controller 25 in this embodiment of the apparatus has an independent drive 54 having a supply circuit 55 connected to a source E of direct voltage. The input of the aforementioned electromagnetic relay is its winding 56 connected to the transducer 30, whereas its output is a break contact 57 in the supply circuit 55 of the drive 54.

Figure 3:
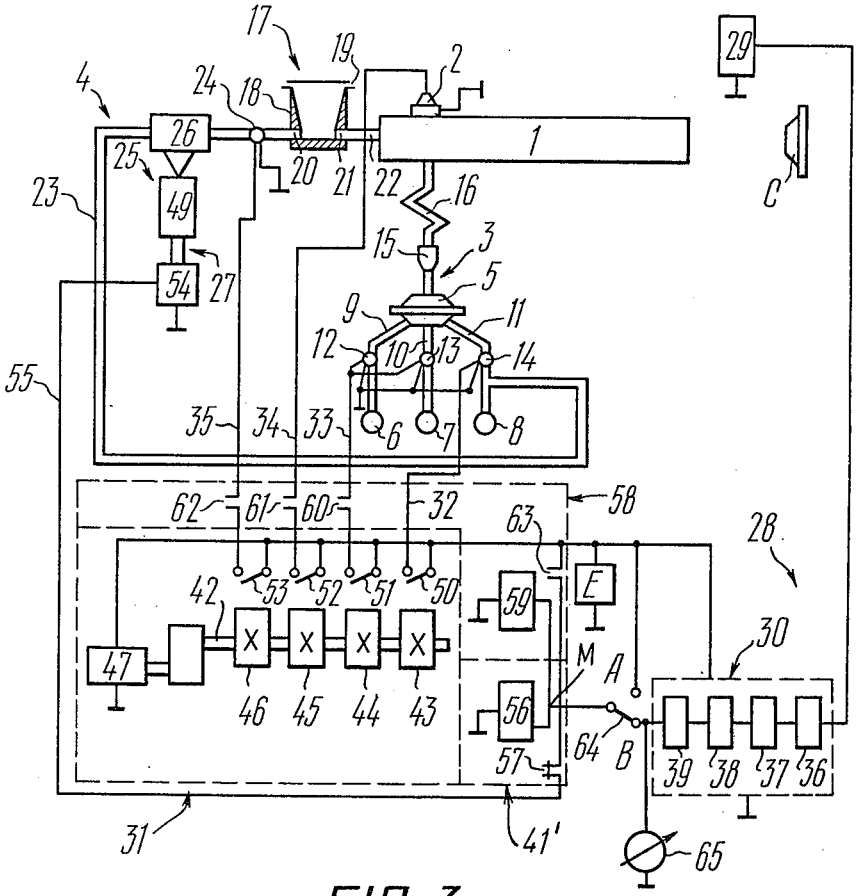
FIG. 3 is a schematic diagram of a preferred embodiment of the apparatus according to the invention.

In the preferred embodiment shown in FIG. 3 the unit 31 comprises, alongside the threshold element 41′ for switching on the drive 54 of the actuating mechanism 27, a threshold element 58 for switching off the apparatus. Operation threshold of the threshold element 58 is lower than that of the threshold element 41, and corresponds to the detector 29 signal indicative of the absence of the powder in the detonation products. The threshold elements 41′ and 58 are the first and the second electromagnetic relays respectively, their windings 56 and 59 serving as their inputs, and being connected to the transducer 30 through their junction point M. The break contact 57 in the supply circuit 55 of the drive 54 serves as the output of the first electromagnetic relay, as in the embodiment shown in FIG. 2. The second electromagnetic relay has several outputs which are make contacts 60, 61, 62 and 63 in the control circuits 33, 34 and 35 and in the supply circuit 55 of the drive 54. The make contact 63 and the break contact 57 in the circuit 55 are connected in series, whereby the possibility of switching on the actuating mechanism 27 of the feed controller 25 in case of simultaneous operation of both electromagnetic relays is eliminated.

The control system 28 has a switch 64 connected between the junction point M of the threshold elements 41 and 59 and the transducer 30, said switch having two positions: A and B. Position B corresponds to a steady-state operation of the apparatus and provides for electric connection of the control unit 31 with the transducer 30. Position A corresponds to adjustment of the apparatus performance at the moment of the first detonation and provides for connection of the control unit 31 with the source E of direct voltage, imitating in this case the detector 29 signal indicative of the full size of the powder portion in the detonation products.

To the output of the power amplifier 39 of the transducer 30 there is connected a device 65 for visually checking the quantity of powder in the detonation products, which device may be a voltmeter, or any other pointer-type instrument.

The above construction of the proposed apparatus is preferable under factory conditions, for it is more reliable and not expensive.

Figure 4:
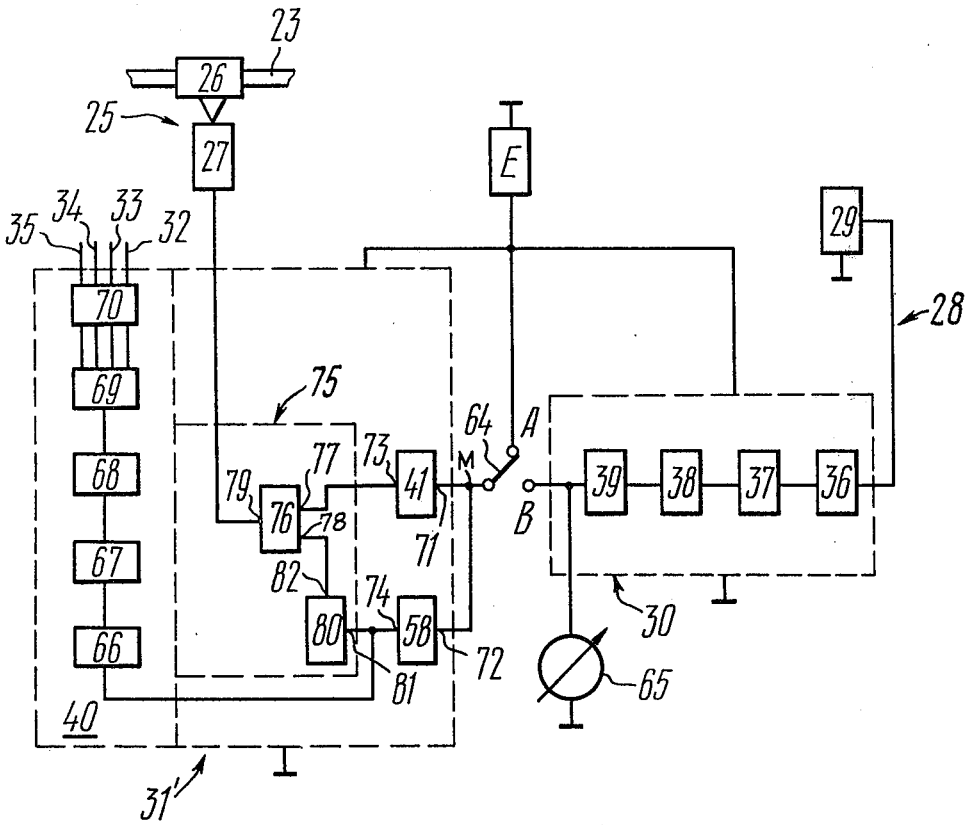
FIG. 4 is a schematic diagram of the control system of an alternative embodiment of the apparatus according to the invention.

Under laboratory conditions, when the principal requirements placed upon the apparatus are high accuracy of control of all the technological parameters, it is preferable that the control unit 31' be constructed as an electronic system, as shown in FIG. 4.

In this case the driver unit 40 is an electronic command apparatus comprising a pulse generator 66, a binary decimal counter 67, a decoder 68, a program setters unit 69 and an amplifiers unit 70 functionally connected in series. The threshold elements 41 and 58 are known in the art electronic devices, and each of them may be constructed in the form of a one-stage amplifier having a common emitter with pre-set cut off voltage being biassed into the transistor base.

Inputs 71 and 72 of the threshold elements 41 and 58 are connected in parallel to the transducer 30 through the junction point M and the switch 64. Outputs 73 and 74 of said threshold elements are connected with the actuating mechanism through the logic circuit 75 comprising a coincidence circuit 76 having a first input 77, a second input 78 and an output 79, and an invertor 80 having an input 81 and an output 82 connected to the second input 78 of the coincidence circuit 76. The first input 77 of the coincidence circuit 76 is connected to the output 73 of the threshold element 41, and the input 81 of the inverter 80 is connected with the output 74 of the threshold element 58, said output being also connected with the driver unit 40. Output 79 of the coincidence circuit 76 is connected to the thyristor drive of the feed controller 25.

The apparatus operates as follows:

For manual operation the control member 26 of the pressure regulator (FIG. 1) is positioned so that the pressure of carrier gas in the gas conduit 23 is somewhat lower than a nominal one, which is done to raise the pressure as the result of said member operation during one hour to nominal value, which provides for feeding a full size of the powder portion to the detonation chamber 1. Thereafter, a button "start" is pressed on the control board (button and board not shown in the drawings), thereby energizing the drive 47 of the driver unit 40 and from the control unit 31 signals are fed to control circuits 32, 33, 34 and 35, which signals provide for operation of controlled mechanisms of the apparatus in required succession. In this case the cam 44 presses the switch 51 closing mixer control circuit 33, said circuit actuating the valves 12 and 13, and a cam 43 presses a switch 50 closing mixer control circuit 32, said circuit actuating the valve 3. As a result fuel, oxidant and neutral gas are passed from respective sources 6, 7 and 8 through the conduits 9, 10, and 11 into the mixer 5, wherein the mixture is produced. The gaseous mixture thus produced is passed through the check valve 15 and the coiled pipe 16 to the detonation chamber 1. As the detonation chamber 1 is filled with the gaseous mixture the cam 46 of the driver unit 40 of the control unit 31 presses a switch 53 closing the control circuit 35 actuating the valve 24 which being opened for the period of time equal to the duration of the closed state of the circuit 35, which duration depends on the profile of the cam 46, provides for delivering carrier gas to the batchmeter 17 and injecting the powder through the delivery pipe 22 into the detonation chamber 1. The quantity of powder thus passed into the detonation chamber 1 (powder portion) depends upon the pressure of carrier gas and the time during which the valve 24 is open. After the detonation chamber 1 is filled with the gaseous mixture and the powdered coating material, the cam 44 of the driver unit 40 releases the switch 51 which breaks the circuit 33, thereby closing the valves 12 and 13 in the fuel and oxidant conduits 9 and 10 respectively. As the valve 14 at that time is still open, neutral gas keeps flowing to the mixer 5, forcing out gaseous mixture from the cavities of the mixer 5, the check valve 15, and the coiled pipe 16. Thereafter the cam 43 in the control unit 31 releases the switch 50, breaking the control circuit 32, which results in the valve 14 closing. Simultaneously, the cam 45 presses the switch 52 which in turn closes the control circuit 34 to cause sparking of the spark plug 2, thereby initiating detonation in the detonation chamber 1. Detonation products entraining the powdered coating material heat and accelerate it. Striking against an article C located in front of the outlet opening of the detonation chamber 1 the powder particles deposit on the surface of the article, forming a coating layer. The detector 29 registers the brightness of two-phase flux when it flows out of the barrel. This brightness depends upon the quantity of powdered coating material contained in the flux. The signal from the detector 29 is fed to the transducer 30, wherein a signal voltage is first amplified (by the amplifier 36), and then a signal power (by the amplifier 37). Being thus amplified the detector 29 signal is fed to the integrating RC circuit comprising a capacitor. Under action of this signal the capacitor is charged, the voltage across the capacitor being directly proportional to the signal. The voltage magnitude across the capacitor of the integrating RC circuit 38 determines the voltage at the output of the power amplifier 39. If the powder portion in the detonation products is full, a signal of pre-determined value is applied from the transducer 30 to the input of the control unit 31. Under action of said signal the normally closed electromagnetic clutch 48, which, until this moment, kept connected the shaft 42 of the command apparatus with the reduction gear 49 of the actuating mechanism of the feed controller 25 uncouples, owing to which the pressure of the carrier gas in the conduit 23 does not change during the next successive operating cycle. If the quantity of powder in the detonation products is not sufficient, which is possible due to the decrease of its level in the hopper 18 or clogging of the pipe 22, the brightness of two-phase flux at the outlet of the barrel also decreases, accordingly lowering the signal, applied from the detector 29 to the transducer 30, and farther to the coil of the electromagnetic clutch 48.

Electromagnetic pull of the coil weakens and under action of a spring (not shown in the drawing) the clutch 48 couples. The reduction gear 49 of the actuating mechanism 27 thus connected with the drive 47 transmits the motion to the control member 26 which increases the pressure of carrier gas in the gas conduit 23. During the next operating cycle within the time when the valve 24 is open, the carrier gas being passed under a high pressure to the batchmeter 17 blows in a considerable quantity of powder into the detonation chamber 1. It should be noted, that increasing the volume of neutral gas in the detonation chamber 1 due to the increased rate of powder feeding has inconsiderable effect upon the composition of the gaseous mixture, for the time period of powder feeding is much shorter than that of the barrel filling with said mixture.

The electromagnetic clutch 48 remains coupled until the detector 29 signal attains the value indicative of the full size of the powder portion in the detonation products.

In one embodiment, the control system 28 of which is shown in FIG. 2, if the size of the powder portion in the detonation products is full, the detector 29 signal being fed to the control unit 31 and amplified by the transducer 30 causes the electromagnetic relay (the threshold element 41') to operate. In this case the contact 57 in the circuit 55 is broken, and the drive 54 of the actuating mechanism 27 is deenergized. With decreasing the detector 29 signal lower than the operating threshold of the electromagnetic relay, the relay is switched off and its contact 57 closed, thereby connecting the drive 54 of the actuating mechanism 27 of the feed controller 25 to the source E of direct voltage. As a result the control member 26 raises the carrier gas pressure, thereby increasing the quantity of powder injected into the detonation chamber 1.

The apparatus in the preferred embodiment, shown in FIG. 3, operates as follows.

Prior to the first operation cycle the switch 64 is put into position A. The control unit 31 is connected to the source E of direct voltage, from which a signal is applied to windings 56 and 59 of the first and the second electromagnetic relays respectively (the threshold elements 41' and 58), said signal imitating the detector 29 signal indicative of the presence of a full size portion of the powder in the detonation products. In this case both electromagnetic relays operate, thereby closing the contacts 60, 61, 62 and 63 in the circuits 33, 34, 35 and 55 and breaking the contact 57. After the required initial pressure in the gas conduit 23 has been built up, the apparatus is switched on. The batchmeter 17, the mixer 5, the spark plug 2, and the units of the control system 28 operate as above. Prior to the second operating cycle (after the first detonation) the switch 64 is put in position B, and further the control unit 31 operates on a signal from the detector 29, amplified by the transducer 30. When the quantity of powder in the two-phase flux flowing from the detonation chamber decreases, the flux brightness lessens bringing down the strength of the detector 29 signal. Finally the moment comes, when the voltage at the output of the power amplifier 30 becomes insufficient for keeping the first electromagnetic relay (the threshold element 41') excited (its operation threshold is higher than that of the second electromagnetic relay). Being deenergized, the first electromagnetic relay makes its contact 57 in the supply circuit 55 of the drive 54, whereby the drive 54 is connected to the source E of direct voltage through contacts 57 and 63. Switching on the drive 54 provides for operation of the feed controller 25, resulting in neutral gas pressure increase in the gas conduit 23 and increasing the portion of powder injected into the detonation chamber 1.

Switching off the drive 54 is effected by exciting the first electromagnetic relay due to the increase of brightness of the two-phase flux.

When there is no powder in the hopper 18 of the batchmeter 17, or the batchmeter 17 is clogged by agglutinated powder particles, the powder may be entirely absent in the detonation products, or its amount may be infinitesimal as well as in the case of the delivery pipe 22 sculling by the powder which is possible due to the back surge.

In such case, as well as in case of misfire, i.e., when the detonation does not occur due to any reason, the voltage at the output of the power amplifier 39 will be insufficient to keep both electromagnetic relays in the state of excitation. The second electromagnetic relay being de-energized, breaks its contacts 60, 61, 62 and 63 in the control circuits 33, 34 and 35 and in the supply circuit 55 of the drive 54 of the actuating mechanism 27 of the feed controller 25. Simultaneously, the first electromagnetic relay is also de-energized, its contact 57 in the circuit 55 is closed without effecting the state of said circuit. Said measures prevent the apparatus from idle running thereby eliminating the waste of gaseous mixture and energy. Besides, worsening of the quality of coating due to the change in physical properties of base layer material, or deposited coating layer material as a result of thermal effect produced by the detonation products is also eliminated.

It should be also noted, that breaking the supply circuit 55 of the drive 54 in case of misfire is a necessary measure for preventing doubling of portion of powder in the detonation chamber during successive detonation, for the excess of powder in the detonation products causes its underheating and ricochetting from the treated surface, which adversely affects the quality of coating.

The quantity of powder contained in the detonation products is controlled according to the readings of the device 65.

The apparatus having alternative construction of the control system 28 (FIG. 4) operates as follows.

The detector 29 signal amplified by the transducer 30, or the imitation of said amplified signal by the source E of direct voltage, is applied to the inputs 71 and 72 of the threshold elements 41 and 58 respectively. When the portion of powder in the detonation products is full or imitated as being full, both threshold elements operate, and signals from their outputs 73 and 74 are applied to the inputs of the logic circuit 75, in which case a signal from the threshold element 58 is applied to the input 81 of the invertor 80 of the logic circuit 75, and a signal from the threshold element 41 is applied to the first input 77 of the coincidence circuit 76. As with the signal being present at the input 81 of the invertor 80, there is no signal at the output 82 thereof and no signal is applied to the second input 78 of the coincidence circuit 76, due to which no signal appears at the output 79 thereof, and the actuating mechanism 27 of the feed controller 25 connected to the output 79 of the coincidence circuit 76 is not switched on. Simultaneously with signals being applied to the inputs of the logic circuit 75, from the output 74 of the threshold element 58 there is applied a signal to the input of the driver unit 40. In this case a generator 66 for shaping square pulses is switched on, which pulses are applied to the input of the binary decimal counter 67 converting the serial number of every pulse applied within an operating cycle of the apparatus into the binary-decimal code.

These pulses are distributed in a decoder 68 so that potentials appear at that pair of its output terminals, which correspond to the code of every pulse being applied. The program setters unit 69, being a unit of decimal switches, selects required pulses according to the program, said pulses being applied through an amplifiers unit 70 to the control circuits 32–35 insures the operation of the spark plug 2, the valves 12–14 and 24 of the mixer and the batchmeter respectively in the succession described above relative to the apparatus, shown in FIG. 1.

When the signal at the output of the transducer 30 becomes lower than the operating threshold of the threshold element 41, thus being indicative of the decreased quantity of powder in the detonation products, no signal is fed from the output 73 of said threshold element to the first input 77 of the coincidence circuit 76. If the signal at the output of the transducer 30 is higher than the operating threshold of the threshold element 58, at the input 81 of the invertor 80 there appears a signal whereas there is no signal at the second input 78 of the coincidence circuit 76. As a result, at the output 79 of the circuit 76 there appears a signal switching on the actuating mechanism 27 of the feed controller 25, said mechanism acting upon the control member 26 of said controller. The pressure of carrier gas in the gas conduit 23 increases, thereby increasing the quantity of powder in the detonation products, which in turn causes the detector 29 signal to increase. When the voltage at the output of the transducer 30 again exceeds the operating threshold of the threshold element 41, there will appear a signal at the output 73 thereof, whereas the signal will disappear at the output 79 of the circuit 76, and the actuating mechanism 27 will be switched off.

If in the course of operation the detector 29 signal amplified by the transducer 30 falls below the operating threshold of the threshold element 58, which is indicative of the absence of powder in the detonation products, the driver unit 40 will be switched off due to the fact that no signal is applied from the output 74 of the threshold element 58 to the input of said unit.

The actuating mechanism 27 of the feed controller 25 will be also switched off because the signal arriving from the transducer 30 to the input 71 of the threshold element 41 is lower than the operating theshold of this threshold element as well which causes the absence of a signal at the output 79 of the coincidence circuit connected with said actuating mechanism.

Thus, in this embodiment of the apparatus there is provided stabilization of the powder portion in the detonation products, and idle running of the apparatus is eliminated.

As follows from the above, the construction of the proposed apparatus contributes to the improvement of coating quality. Besides, the described embodiment of the control system of the apparatus insures successive and cyclic operation Thereof irrespective of accidental disturbances which may occur during the operation thereof. The presence of a powder detector in said system provides for feed back enabling extension of the service life of the apparatus as a whole.

While the invention has been described herein in terms of embodiments various modifications thereof will be apparent to those skilled in the art, and therefore departures may be made therefrom within the spirit and scope of the invention as defined in the claims.

What is claimed is:

1. Apparatus for coating by detonation waves comprising:

a detonation chamber including a barrel having an open end and a closed end;

a spark plug mounted in said detonation chamber;

a powder feeding system communicating with said detonation chamber, and comprising:

a source of carrier gas;

a gas conduit communicating with said source of carrier gas; and a batchmeter comprising a hopper having a first inlet for charging powdered coating material, a second inlet connected with said gas conduit, and an outlet connected with said detonation chamber;

a carrier gas feed controller having a control member mounted on said gas conduit, and an actuating mechanism connected with the control member;

a gaseous mixture delivering system comprising a mixer communicating with the detonation chamber;

a control system electrically connected with the mixer, the batchmeter, and the carrier gas feed controller, and comprising a powder detector for detecting powder in the detonation products and mounted at the open end of said barrel;

a transducer for converting a detector signal and electrically connected with said powder detector;

a control unit comprising a driver unit electrically connected with said mixer, said spark plug and said batchmeter, and a threshold element for switching on said actuating mechanism of said carrier gas feed controller, said threshold element having an input connected to said transducer and an output electrically connected with said actuating mechanism of said carrier gas feed controller; and control circuits of the mixer, of the spark plug and of the batchmeter connecting said driver unit of said control unit with said mixer, said spark plug and said batchmeter respectively.

2. Apparatus according to claim 1, wherein said carrier gas feed controller for controlling the quantity of carrier gas being fed to said batchmeter within a unit of time is a pressure regulator.

3. Apparatus according to claim 1, wherein said powder detector is a photocell.

4. Apparatus according to claim 1, wherein said control system comprises a device for visual control of the quantity of powder in the detonation products, connected to said transducer.

5. Apparatus according to claim 1, wherein said control unit further comprises a threshold element for switching off the apparatus, said threshold element having an operation threshold lower than that of said threshold element for switching on the actuating mechanism, and corresponding to the signal of said powder detector, indicative of the absence of powder in the detonation products, said threshold element for switching off the apparatus has an input connected to said transducer in parallel with the input of said threshold element for switching on the actuating mechanism, and an output electrically connected with said carrier gas feed controller in such a manner that, in case of simultaneous operation of said threshold elements, the actuating mechanism of said carrier gas feed controller is switched off, said control system having a switch installed between said transducer for converting detector signal and the junction point of said threshold elements, said switch being intended for connecting said threshold elements, for the first shot, with the source of direct voltage imitating the signal of said powder detector, indicative of a full portion of powder in the detonation products.

6. Apparatus according to claim 5, wherein said actuating mechanism of the carrier gas feed controller comprises a drive having an individual supply circuit, and said threshold element for switching on the actuating mechanism and said threshold element for switching off the actuating mechanism are first and second electromagnetic relays respectively, the first electromagnetic relay has a break contact in the supply circuit of said drive, and said second electromagnetic relay has closing contacts in said control circuits of the mixer, of the spark plug, and of of the batchmeter, and a closing contact in the supply circuit of said drive, said closing contact being connected in series with said breaking contact of said first electromagnetic relay, thereby eliminating the possibility of switching on the actuating mechanism of said carrier gas feed controller in case of simultaneous operation of said electromagnetic relays.

7. Apparatus according to claim 5, wherein the actuating mechanism of said carrier gas feed controller is constructed in the form of a thyristor drive, and said control unit comprises a logic circuit containing a coincidence circuit having first and second inputs and an output, and an invertor having an output connected to the second input of said coincidence circuit and an input, the first input of said coincidence circuit being connected to the output of said threshold element for switching on the actuating mechanism, and the output of said coincidence circuit being connected with said thyristor drive, the input of said invertor being connected with the output of said threshold element for switching off the apparatus, and the output of the same threshold elements being connected with said driver unit.

* * * * *